US006525661B2

(12) United States Patent
Tsai

(10) Patent No.: US 6,525,661 B2
(45) **Date of Patent: *Feb. 25, 2003**

(54) ELECTRONIC ARTICLE SURVEILLANCE MARKERS FOR OPTICALLY RECORDED MEDIA

(75) Inventor: Ching-Long Tsai, Woodbury, MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/258,460

(22) Filed: Feb. 26, 1999

(65) Prior Publication Data

US 2002/0140556 A1 Oct. 3, 2002

(51) Int. Cl.[7] ..... G08B 13/14

(52) U.S. Cl. ..... 340/572.4; 340/572.1; 340/572.3

(58) Field of Search ..... 340/572.4, 572.1, 340/572.3, 572.6, 551

(56) References Cited

U.S. PATENT DOCUMENTS

| | | | | | |
|---|---|---|---|---|---|
| 4,710,754 | A | | 12/1987 | Montean | 340/572 |
| 4,746,908 | A | * | 5/1988 | Montean | 340/551 |
| 4,825,197 | A | | 4/1989 | Church et al. | 340/572 |
| 4,829,288 | A | * | 5/1989 | Eosembeis | 340/551 |
| 4,884,063 | A | | 11/1989 | Church et al. | 340/572 |
| 4,967,185 | A | | 10/1990 | Montean | 340/572 |
| 5,121,106 | A | | 6/1992 | Kataria et al. | 340/572 |
| 5,347,508 | A | | 9/1994 | Montbriand et al. | 369/273 |
| 5,432,499 | A | * | 7/1995 | Montean | 340/572.1 |
| 5,580,664 | A | * | 12/1996 | Tsai | 340/572.1 |
| 5,699,047 | A | | 12/1997 | Tsai et al. | 340/572 |
| 5,825,292 | A | | 10/1998 | Tsai et al. | 340/572 |
| 5,835,016 | A | * | 11/1998 | Ho et al. | 340/568 |
| 5,939,985 | A | * | 8/1999 | Tsai et al. | 340/572.1 |
| 6,023,226 | A | * | 2/2000 | Morin et al. | 340/572.1 |
| 6,097,291 | A | * | 8/2000 | Tsai et al. | 340/572.6 |

FOREIGN PATENT DOCUMENTS

| | | | |
|---|---|---|---|
| EP | 0 628 936 | 12/1994 | G08B/13/24 |

* cited by examiner

*Primary Examiner*—Nina Tong
(74) *Attorney, Agent, or Firm*—Peter L. Olson; Melissa E. Buss

(57) ABSTRACT

An electronic article surveillance marker is disclosed, including a signal producing layer and a signal blocking layer. The signal producing layer includes flux collection portions joined by magnetic switching sections each having a major axis A, and the signal blocking layer comprises signal blocking elements overlying each flux collection portion. The elements each have at least one boundary that overlies a magnetic switching section and preferably has a tangent T that is not perpendicular to the major axis A of that magnetic switching section. Methods of making the inventive marker are also disclosed.

9 Claims, 5 Drawing Sheets

ELECTRONIC ARTICLE SURVEILLANCE MARKERS FOR OPTICALLY RECORDED MEDIA

TECHNICAL FIELD

The invention relates to electronic article surveillance markers of the type used with optically recorded media for use with magnetic-type electronic article surveillance systems.

BACKGROUND OF THE INVENTION

Magnetic-type electronic article surveillance ("EAS") systems are widely used to inhibit the theft of merchandise such as clothing, books, cassettes, and compact discs. EAS systems are often used to prevent the unauthorized removal of articles from a protected area, such as a library or retail store. An EAS system usually includes an interrogation zone or corridor located near the exit of the protected area, and markers or tags attached to the articles to be protected. EAS systems have been based on magnetic, RF, microwave, and magneto-strictive technologies, but regardless of the particular technology involved, the systems are designed such that the tag will produce some characteristic response when exposed to an interrogating signal in the corridor. Detection of this characteristic response indicates the presence of a sensitized tag in the corridor. The EAS system then initiates some appropriate security action, such as sounding an audible alarm, locking an exit gate, or the like. To allow authorized removal of articles from the protected area, tags that are either permanently or reversibly deactivatable (referred to as "single-status" and "dual-status" markers, respectively) are often used.

Although EAS markers have been in use for the theft protection of optically recorded media such as compact discs and CD-ROMs, the markers have generally been adapted for attachment to the packages containing new compact discs and have been poorly suited for direct attachment to the disc itself. One solution to this problem is posed in coassigned U.S. Pat. No. 5,699,047 (Tsai et al.) and U.S. Pat. No. 5,825,292 (Tsai et al.), which describe a marker including one or more marker elements attached to a flexible support sheet. The support sheet (or in one embodiment only the marker elements) may be adhered to the optical disc such that the marker elements are symmetrically spaced with respect to the center of the disc, to avoid upsetting the balance of the disc when it is rotated. However, as ever greater amounts of information are stored on a single optically-recorded disc, manufacturers have sought to record on both sides of that disc. Thus, any marker element that covers an area of the disc where optical information is or may be recorded and must be read can be undesirable.

U.S. Pat. No. 5,347,508 (Montbriand et al.) discloses another style of EAS marker in combination with an optical disc. The marker, in the form of a ring, comprises concentric signal-producing and signal-blocking layers that combine to provide a dual-status marker that can be embedded into a circular channel formed near the center of the disc. The marker disclosed in this patent used a contiguous signal blocking layer, and the bias field from that signal blocking layer provides the deactivation mechanism. Although having its own utility, EAS markers of the type disclosed in Montbriand et al., with a contiguous signal blocking layer, may not be sufficiently effective in deactivating the marker under all circumstances.

In view of the foregoing, it would therefore be desirable to provide an EAS marker that overcomes the disadvantages of conventional EAS markers for optically-recorded media.

SUMMARY OF THE INVENTION

The present invention includes within its scope an electronic article surveillance marker comprising a signal producing layer including flux collection portions joined by magnetic switching sections, and a signal blocking layer comprising signal blocking elements overlying each flux collection portion, the elements each having at least one boundary that overlies a magnetic switching section. In a preferred embodiment, the magnetic switching sections each have a major axis A, and the signal blocking elements each have at least one boundary that overlies a magnetic switching section and has a tangent T that is not perpendicular to the major axis A of that magnetic switching section. The marker preferably is suitable for use on an optical disc, though it may be used on other articles as well.

Methods of making the inventive marker are also disclosed, including by making the signal producing layer and the signal blocking layers separately and laminating them together, or by chemically etching away from a substrate the materials of each layer that are not required.

BRIEF DESCRIPTION OF THE DRAWINGS

The present invention will be described in greater detail with reference to the appended Figures, in which.

DETAILED DESCRIPTION OF THE INVENTION

The present invention relates to a dual-status EAS marker for attachment to the non-recorded, or "hub" region of an optically-recorded disc. The marker includes a first annular signal-producing layer formed from a soft magnetic material with high permeability and low coercivity, and a signal blocking layer (that is preferably discontinuous) formed from a remanently magnetizable material. The signal producing layer is designed with flux collection portions that produce a sizable EAS signal to aid in the detection of the marker, and the signal blocking layer has a unique pattern for effectively deactivating the marker.

Markers of the type disclosed herein may commonly be used with optical discs, though they may be used with other suitable articles as well. For simplicity, the marker of the invention will be described largely with reference to an embodiment used in conjunction with an optical disc, and where preferred dimensions are given they refer to such an embodiment. The respective layers of the marker, and the process used to make the marker, are described in greater detail below.

I. The Signal Producing Layer

Figure 1:
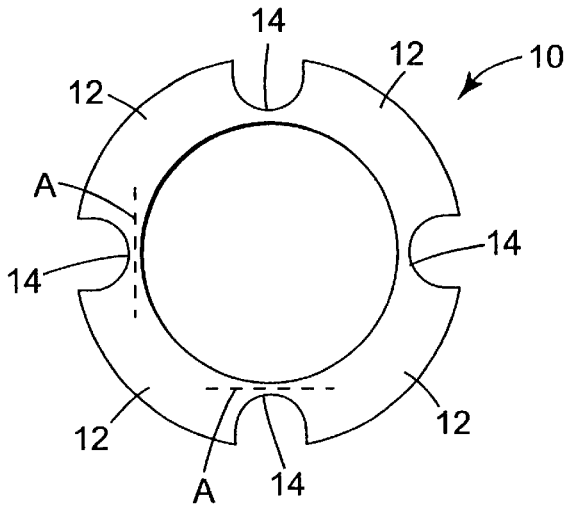
FIGS. 1 and 2 are plan views of two embodiments of a signal producing layer according to the present invention.

One embodiment of a signal producing layer 10 is shown in FIG. 1. It is contiguous about a center point, and includes four flux collection portions 12 joined together by four magnetic switching sections 14. Magnetic flux travels from the flux collection portion through the magnetic switching sections to produce a signal that may be detected by an interrogation system in accordance with known principles. See, for example, U.S. Pat. No. 4,710,754 (Montean), the entire contents of which is incorporate by reference herein, and specifically col. 3, lines 29 through 52 and column 4, lines 27 through 39. Each magnetic switching section includes a major axis "A," the importance of which is described in reference to a preferred embodiment below. In the illustrated embodiment, the major axis A is a line drawn through the midpoint of the magnetic switching section and extending in the direction of two opposed flux collection portions. Another embodiment of a signal producing layer 10*a* is illustrated in FIG. 2, including flux collection portions 12*a* and magnetic switching sections 14*a*.

The signal producing layer may be made from high permeability, low coercive force ferromagnetic material such as permalloy, supermalloy, or amorphous magnetic alloys. One example of such a material is an amorphous magnetic alloy consisting of about 67 atomic percent cobalt, 5 percent iron, 12 percent boron, and 13 percent silicon, which is commercially available from AlliedSignal Corporation of Parsippany, N.J. under the designation 2705M. Another suitable material that may be used for a signal producing layer is permalloy consisting of 80 weight percent nickel, 4.2 percent molybdenum, and 15 percent iron, which is commercially available from Carpenter Technology of Reading, Pa. under the designation "HyMu 80."

Figure 2:
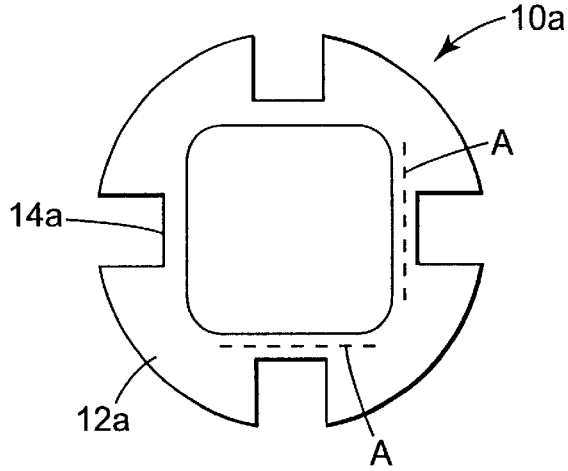
Figure 4:
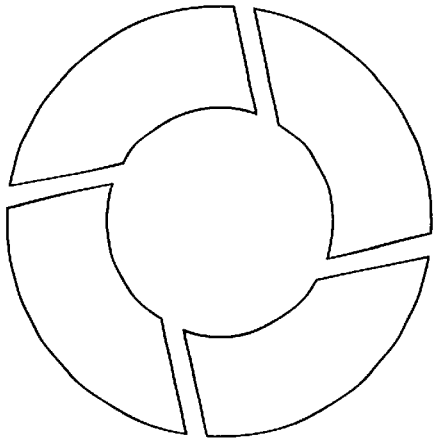
FIGS. 4, 5, 6, and 7 are additional embodiments of signal blocking layers with complementary boundaries, according to the present invention.
Figure 5:
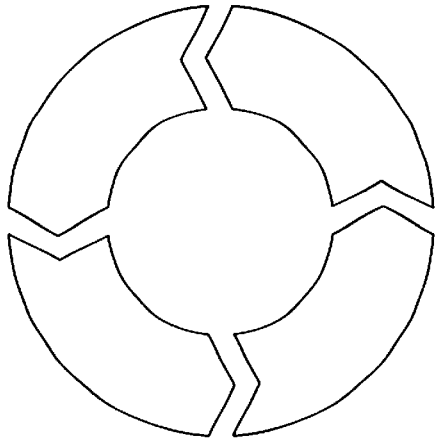
Figure 6:
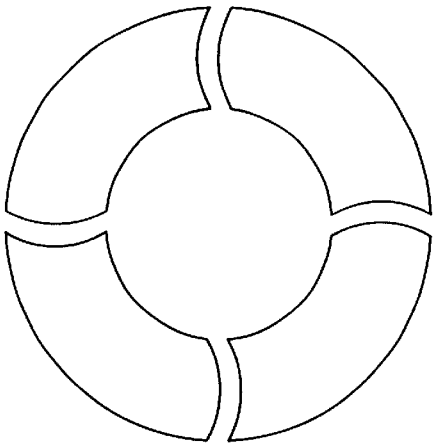
Figure 7:
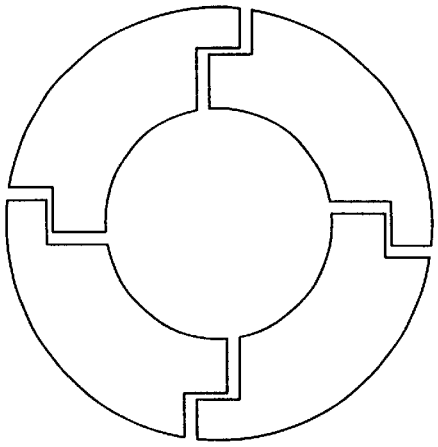

FIGS. 1 and 2 illustrate just one arrangement of the switching sections 14/14*a* and flux collection portions 12/12*a* that make up the signal producing layer 10/10*a*. The signal producing layer may have two or more flux collection portions, which are preferably symmetrical and evenly spaced from one another. Although the illustrated embodiments show four flux collection portions, markers with more or less flux collection portions are also believed to be useful in connection with the teachings of the present invention, and are within the scope thereof. For example, a triangular signal producing layer having flux collection portions nearest each of the corners, and switching sections between them, may also be used, as shown in FIG. 4 of U.S. Pat. No. 4,710,754 (Montean). Each of the flux collection portions is formed of co-planar section of a sheet-like material of low coercive force, high permeability material. The width of a flux collection portion is preferably at least ten times the minimum width of a magnetic switching section.

When used with an optical disc, the maximum outer diameter (OD) of the signal producing layer preferably is less than 4.6 cm (1.81 in), and is more preferably less than 3.5 cm (1.38 in). The minimum width of each switching section is preferably between 0.127 and 1.27 mm (0.005 and 0.05 in). The length of the switching sections normal to the minimum width is preferably within the range of 1.0 to 15 mm (0.04 to 0.6 in). The thickness of the signal producing layer is preferably less than 0.0254 mm (0.001 in).

II. The Signal Blocking Layer

Figure 3:
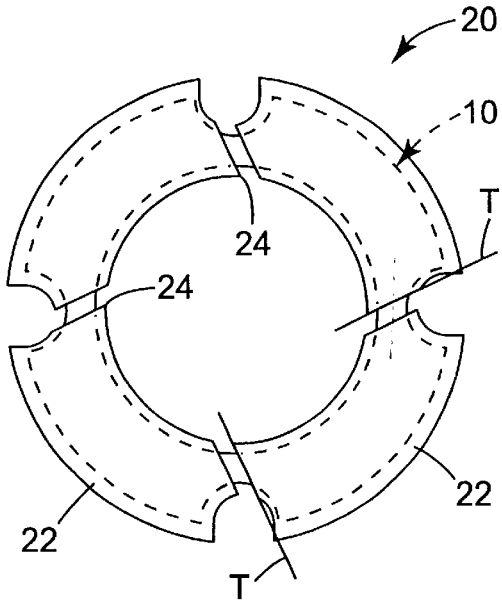
FIG. 3 is a plan view of a signal blocking layer according to the present invention, overlying a signal producing layer shown in ghost lines.

To make a dual-status marker, a signal blocking layer is provided to render the signal producing layer undetectable by an interrogation system. Preferable signal blocking layers are those magnetic materials that have a coercive force of between 20 and 400 Oersteds, and high residual magnetization. When the signal blocking layer is appropriately magnetized, it interrupts the magnetic switching within the magnetic switching sections of the signal producing layer, and thereby renders the signal producing layer undetectable by an interrogation system. One arrangement of the signal blocking layer 20 is shown in FIG. 3, in which the perimeter of an underlying signal producing layer 10 is shown in ghost lines to illustrate the relative arrangement of the two layers in a finished EAS marker. Note that the signal blocking layer is preferably slightly larger than the signal producing layer, which helps to deactivate the signal producing layer.

The signal blocking layer includes signal blocking elements 22 that generally overlie each flux collection portion 12, and are preferably but not necessarily discrete from each other. That is, the signal blocking layer may include two or more discrete signal blocking elements 22, or two or more signal blocking elements that are formed in a contiguous arrangement. Each signal blocking element has at least one boundary that generally overlies a magnetic switching section, and in the case of the signal blocking elements shown in FIG. 3, each such element has a boundary that overlies two magnetic switching sections. In a preferred embodiment, at least one of the boundaries that overlies a magnetic switching section has a tangent "T" that is not perpendicular to the major axis "A" of that magnetic switching section. This arrangement causes flux in the signal blocking element to localize at a desired point (flux concentration points 24, in FIG. 3), and from that point to travel through the adjacent magnetic switching section. That flux biases the magnetic switching section and prevents the signal producing layer from producing a detectable signal, which is believed to be because the magnetic properties of the respective switching sections of the signal producing layer are altered, or reduced, so that the amplitude of the alternate polarity switching pulses from the respective elements is also significantly altered or reduced. In this way, the activation of the signal blocking layer prevents detection of the signal producing layer, and thus prevents detection of the marker. Flux concentration points 24 are an optional, but preferred, feature of the present invention.

Figure 8:
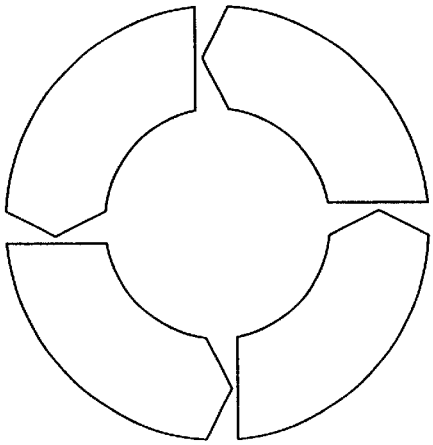
FIG. 8 is an additional embodiment of a signal blocking layer with non-complementary boundaries according to the present invention.

In the signal blocking layer embodiments shown in FIGS. 4 through 7, the boundaries of adjacent discrete signal blocking elements are complementary, meaning that if the adjacent portions 22 were joined together they would meet along a single continuous line. Complementary boundaries between adjacent signal blocking elements are also an optional, but preferred, feature of the present invention. Adjacent signal blocking elements may also have non-complementary boundaries, such as those shown in FIG. 8.

One suitable material for the signal blocking layer is an iron-based alloy consisting of 76 weight percent iron, 20 percent nickel, and 4 percent molybdenum, which is commercially available from Carpenter Technology of Reading, Pa. under the designation "MagneDur." The coercive force of MagneDur is about 45 to 65 Oersteds, and the residual magnetization is above 10,000 Gauss. Another suitable material for the signal blocking layer is an iron-chromium alloy consisting of 64 weight percent iron, 6.8 percent cobalt, 28.3 percent chromium, and 0.2 percent nickel, which is commercially available from Arnold Engineering Company of Marengo, Ill. under the designation "Arnokrome 3." The coercive force of Arnokrome 3 ranges from 50 to 200 Oersteds, and the residual magnetization is also above 10,000 Gauss. Other magnetic materials which are suitable as signal blocking layer include Vicalloy, Chromindur II, or the like, as known to those of ordinary skill in the art.

III. The Marker

A marker of the present invention is typically used as a dual status marker, meaning that the marker may be activated and deactivated, preferably repeatedly. The marker is said to be activated when the signal blocking layer is demagnetized, because the signal producing layer will generate a high harmonic signal that is detectable by conventional magnetic interrogation systems such as those available from the Minnesota Mining and Manufacturing Company of St. Paul, Minn. (3M Company). The marker is said to be deactivated when the signal blocking layer is magnetized, because the signal blocking layer generates sufficient magnetic flux to substantially saturate, or lock up, the switching section of the signal producing layer, thus preventing detection of the marker. Markers may be deactivated as is known in the art by, for example, passing the marker over a permanent magnet having a substantially uniform magnetic field of a single polarity. To activate the marker again, the marker may be passed over an alternating magnetic field of decaying amplitude, as is known in the art, to demagnetize the signal blocking layer.

Figure 9:
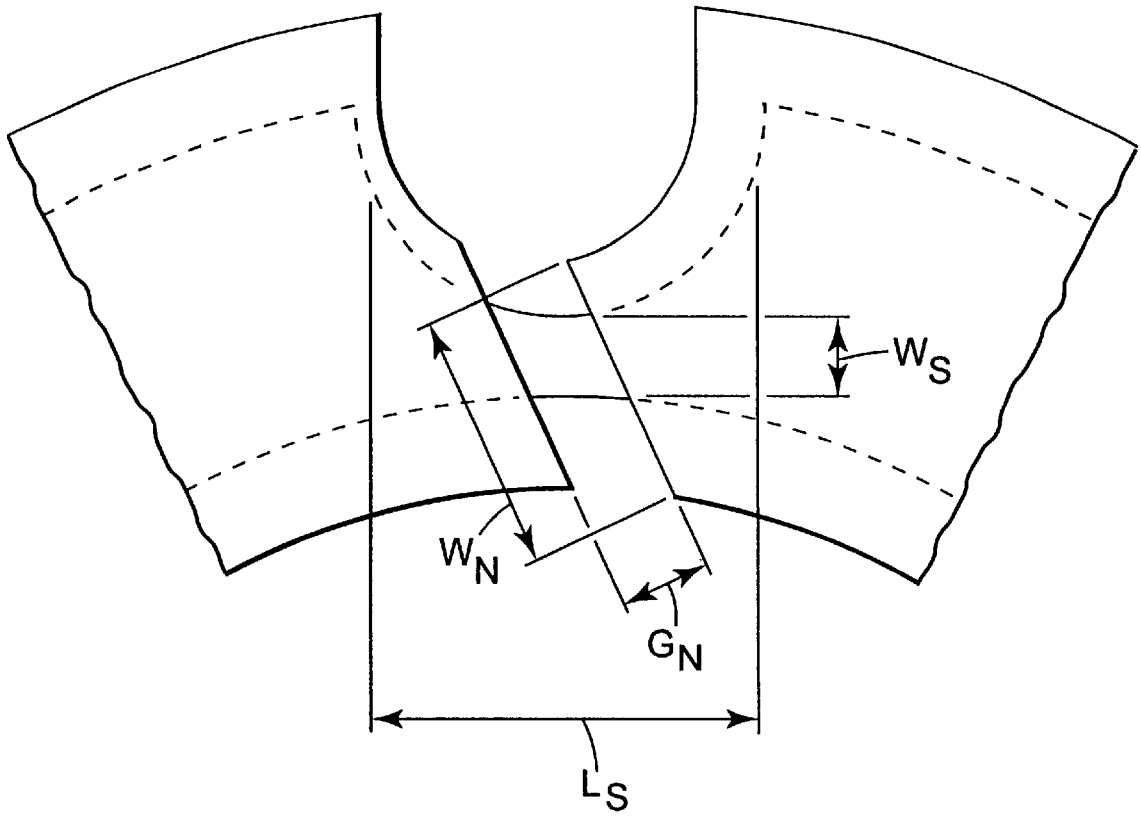
FIG. 9 is a magnified illustration of certain relative dimensions associated with the electronic article surveillance marker of the present invention.

A particular advantage of the inventive marker is that it may be desensitized by the application of a desensitizing field applied at any orientation relative to the marker. More specifically, the desensitizing field may be applied at any orientation relative to the signal blocking layer to deactivate the marker. Markers of this type are said to be "multidirectionally responsive." This characteristic is not always true of conventional markers, but is believed to be true of the markers of the present invention based on tests that show complete deactivation of the marker The parameters of the signal producing layer and the signal blocking layer, and specifically the relationship between the two near the magnetic flux areas may be described with reference to FIG. 9, in which the signal blocking layer overlies the signal producing layer. As shown therein, the width of the narrow region $W_N$ of the signal blocking layer is preferably slightly larger than the width of the switching section $W_s$ of the signal producing layer. The gap $G_N$ between adjacent portions of the signal blocking layer in the narrow region is not critical, but is preferably larger than the width of the switching section $W_s$ for the signal producing layer, and smaller than the length of the switching section of the signal producing layer $L_s$. The length $L_s$ is measured between the lines perpendicular to the switching section at which the width of the switching section becomes more than 5 times larger than the minimum width of the switching section. In the embodiment shown in FIG. 9, $L_s$ is approximately 4.1 mm (0.16 in), $W_N$ is approximately 2.0 mm (0.08 in), $W_s$ is approximately 0.76 mm (0.03 in), and $G_N$ is approximately 1.52 mm (0.06 in). Other suitable dimensions may be selected to provide a marker with the desired properties and performance.

The thickness of the signal blocking layer is also preferably greater than or equal to that of the signal producing layer, and the outer diameter of the signal blocking layer is preferably greater than, and the inner diameter less than, the signal producing layer. This enables the signal blocking layer to deactivate the signal producing layer, and thus the entire marker, more reliably. In a preferred embodiment as shown in FIGS. 1 through 3, the signal producing layer could be made of a sheet of permalloy, 0.01524 mm (0.0006 in) thick. The corresponding signal blocking layer could preferably be made of a sheet of MagneDur, 0.0381 mm (0.0015 in) thick.

Although both the signal producing layer and the signal blocking layer, and thus the marker itself, may be made in any suitable size, it is preferred to make the marker small enough to fit within the non-recorded area (the hub) of an optical disc. Those dimensions, for one common type of disc, are an outer diameter of 46 mm (1.81 in) and an inner diameter of 15 mm (0.59 in).

To apply the marker to an object, such as an optically recorded medium, an adhesive that adheres to but is inert relative to the object is preferably provided on a surface of the marker. One such adhesive is available from 3M Company under the designation 9461P Transfer Adhesive. Other adhesives that do not significantly adversely affect the performance or appearance of the object may also perform satisfactorily.

The marker may also be provided with a print receptive layer, which can be printed with indicia such as a logo or alphanumeric information designating the owner or source of the article to which the marker is attached.

IV. Manufacturing the Marker

The marker of the present invention may be manufactured in any suitable manner by, for example, laminating signal producing and signal blocking layers together, or by etching signal producing and signal blocking layers on opposed sides of a single substrate. These methods are described in greater detail below.

A. Laminating: One method of making the markers of the present invention is by forming the signal producing and signal blocking layers separately, and then laminating them together in registration. For example, a sheet of suitable material may be stamped or otherwise formed in the pattern shown in FIG. 10 to make the signal producing layers for many adjacent markers, and another sheet of suitable material may be stamped or otherwise formed in the pattern shown in FIG. 11 to make the signal blocking layer for those markers. The two sheets can then be adhesively or otherwise laminated together in registration, and die cut along the illustrated ghost lines to provide a marker that resembles the one shown in FIG. 3. The markers may then be cut into strips as shown in FIG. 12, and provided in a manner suitable for dispensing.

B. Etching: Another method of making the marker of the present invention is to laminate signal producing layer material (such as permalloy) and signal blocking layer material (such as MagneDur) onto opposite surfaces of a sheet of polymeric material (preferably a 0.001 inch thick polyester). The sheets may be laminated together with a 0.0254 mm (0.001 in) thick layer of a transfer adhesive manufactured by Minnesota Mining and Manufacturing Company (3M).

Figure 10:
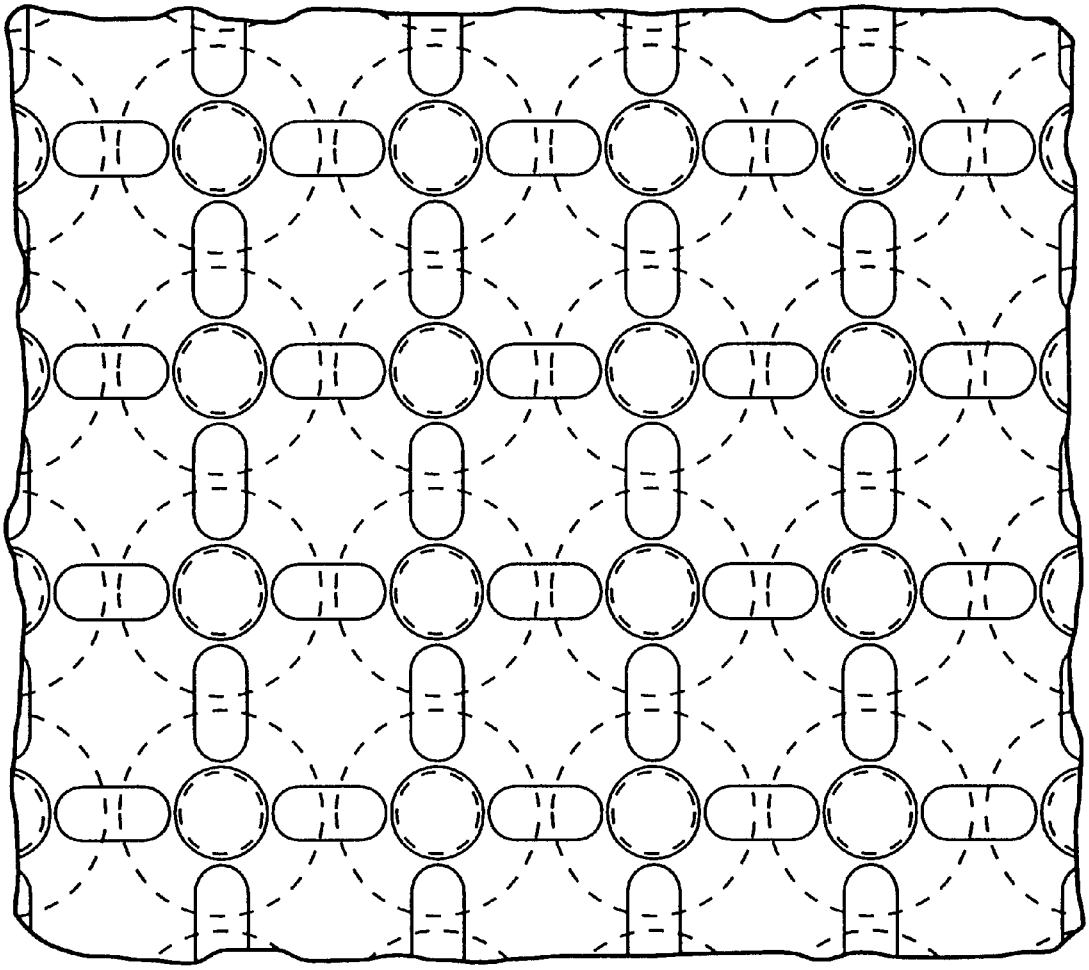
FIG. 10 is an illustration of a sheet of material stamped with an array of signal producing layers for use in an EAS marker of the present invention.
Figure 11:
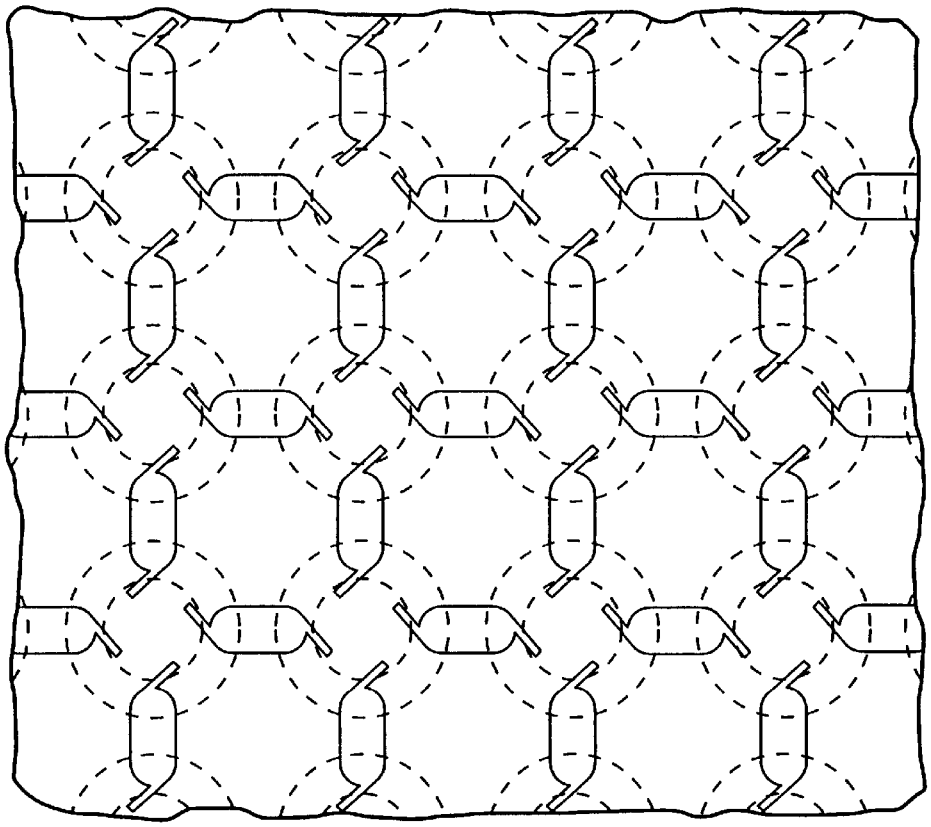
FIG. 11 is an illustration of a sheet of material stamped with an array of signal blocking layers for use in an EAS marker of the present invention.
Figure 12:
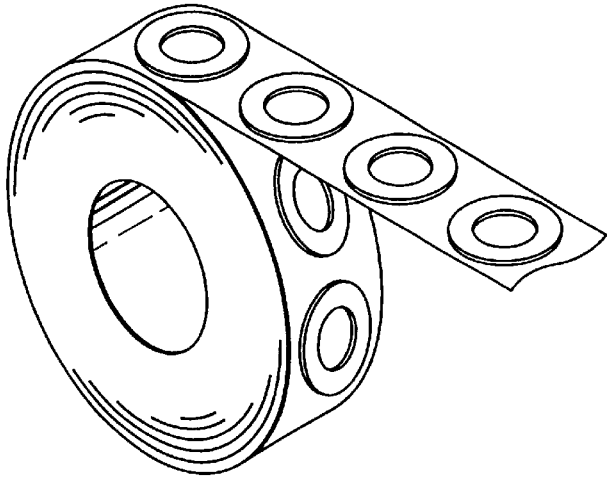
FIG. 12 is an illustration of several EAS markers provided on a release liner according to the present invention.

After lamination, both signal producing layer and signal blocking layer surfaces may be coated with a layer of acid resist material of a desirable pattern, such as those shown in FIGS. 10 and 11, respectively. The laminate may then be appropriately processed to remove the portions of the respective metal sheets that are not covered by the resist, such as by a conventional acid etching treatment that etches away the exposed metal surfaces from each of the respective layers, leaving behind the portions of the metal layers covered by the resist material. When the acid resist material is removed, an EAS marker results.

The choice of the etchant depends on the materials used as signal producing and signal blocking layers. The suitable etchants for permalloy and MagneDur include phosphoric acid ( $H_3PO_4$), ferric chloride ($FeCl_3$), and mixed acids, (see CRC Handbook of Metal Etchants, edited by Perrin Walker and William H. Tarn, CRC Press, 1991), or mixture of nitric Acid (1 part) and acetic acid (1 part), or aqua regia (nitric acid (1 part) and hydrochloride acid (3 part)). (see Smithells Metals References Book, edited by E. A. Brandes and G. B. Brook, 7th ed. Butterworth Heinmann, 1992). One preferred etchant used in this invention is a mixture of ferric chloride, hydrochloric acid, and ammonium chloride solution.

The choice of the etching process depends on the materials used as signal producing and signal blocking layers. For example, the signal producing layer may be a 0.0006 inch thick permalloy and the sheet of signal blocking layer may be a 0.0015 inch thick MagneDur, and each sheet may require different exposure to etching conditions to remove the exposed metal. If a single etching bath is used, the combined laminate layers may be first exposed for a shorter period to remove the thinner permalloy. The laminate may then be removed from the bath and the permalloy covered to protect that layer from further etching. The laminate may then be reinserted into the etching bath and etching continued until the undesirable portions of the signal blocking layer are removed.

The resulting patterned laminate may then be formed into a final EAS marker by adhering a layer of printable paper or label stock over the signal blocking layer to form a printable surface, and by adding a layer of transfer adhesive and a release liner to the exposed side of permalloy sheet. The final laminate may then be subject to the die-cut to produce the desirable marker geometry. The undesirable weed may then be peeled off to leave only the final EAS markers on the release liner. For example, dual status EAS markers for optically-recorded media could be produced by punching rings having an outer diameter of 41 mm (1.625 in) and an inner diameter of 16 mm (0.625 in).

V. Detection of the Marker

The detection systems may be amplitude detection systems, which respond to a signal of a certain amplitude, or phase sensitive detection systems, which respond to a certain signal profile. To deactivate a marker so that neither system can detect it, the marker must produce a signal that has both an amplitude below the detection limit of the amplitude detection system, and a signal that does not match the signal profile expected by the phase sensitive detection system. Amplitude detection systems are available from 3M under the designations 1850, 1360, and 2300. Detection systems that detect phase, polarity, and amplitude are available from 3M under the designations 3300 and 3800, and are often used when the amplitude of a deactivated marker is still sufficiently high to trigger an alarm in an amplitude detection system. The markers of the present invention may be completely deactivated, so that neither type of detection system will detect the marker, and thus either type of detection system may be used.

A more detailed description of a conventional detection system is provided in U.S. Pat. No. 4,967,185 (Montean), the entire contents of which is incorporated by reference herein. Specifically, phase sensitive detection systems typically include two spaced panels between which persons carrying objects protected by EAS markers must pass to be removed from the secured area. Field coils and detector coils are positioned within the panels. The field coil is powered by a suitable oscillator coupled through a drive amplifier, which produces a magnetic field oscillating at a predetermined frequency within the interrogation zone extending between the panels. One common frequency is approximately 10 kilohertz. The detector coil is coupled through a sense amplifier and filter, and then to a pair of level detectors and to a phase sensitive detector. The common outputs of those three detectors are coupled to an alarm logic network, which is basically an exclusive "AND" gate, such that an appropriate signal from all three detectors must be present to activate an alarm. That is, if the signal pulses do not exceed a minimum threshold, the level detectors (and thus the alarm signal) will not be activated, and if the signal pulses are shifted, the phase sensitive detection system (and thus the alarm signal) will not be activated. In the case of amplitude detection systems, if the amplitude of the marker is sufficiently low when it is desensitized, the alarm signal also will not be activated.

If a patron carrying objects having activated markers (that is, the signal blocking portions have been deactivated) passes between the panels, the presence of the markers will be detected and an alarm will be produced. Conversely, if prior to passing between the panels the markers are deactivated (that is, the signal blocking portions have been activated), no alarm will sound. The present invention may also be understood with regard to the following examples, which are illustrative but nonlimiting of the invention.

EXAMPLES

Example One

A 0.0152 mm (0.0006 in) thick foil made of nickel and iron of the type available from Carpenter Technology Company of Reading, Pa. under the designation HyMu 80, measuring about 5.1 cm (2 in) square, was laminated to a piece of equal or larger size of adhesive coated paper. This laminate was then punched into a pattern as shown in FIG. 1. The punched sample was then stamped into a concentric ring with a 15.88 mm (0.625 in) inner diameter and a 34.93 mm (1.375 in) outer diameter to form the signal producing layer.

The signal blocking layer was also produced by punching and shearing of 0.041 mm (0.0016 in) thick iron-chrome alloy of the type sold by the Arnold Engineering Company of Marengo, Ill. under the designation "Arnokrome 3," with a pattern as shown in FIG. 3. The signal blocking layer had the same inner and outer diameters as a signal producing element.

The signal producing layer was then bonded to the signal blocking layer with a transfer adhesive of the type available from 3M under the designation Scotch Laminating Adhesive 467M to form a dual-status EAS marker.

The signal producing layer yielded a detectable EAS signal when the signal blocking layer was in the demagnetized state. After the signal blocking element was magnetized by exposure to a 150 gauss DC magnetic field, the signal producing layer did not generate detectable EAS signals when subjected to interrogating fields of up to 15 Oersteds. The signal blocking element could be deactivated at any orientation relative to the deactivating field, meaning that the marker was multi-directional.

Markers of the type described in this Example are believed to be useful with interrogation systems of the type available from 3M Company under the designation model 3800 detection system.

Example Two

A length of 0.015 mm (0.0006 in) thick nickel-iron foil available from Carpenter Technology company of Reading, Pa. was laminated to a similar length of 0.375 mm (0.0015 in) thick nickel-iron-molybdenum foil available from Carpenter Technology company under the designation "MagneDur" of about the same length. The nickel-iron foil side was then printed with the signal producing layer pattern shown in FIG. 1. The nickel-iron-molybdenum foil side was printed with the signal blocking layer pattern shown in FIG. 3.

The foil laminate was chemically etched on both sides by exposing the laminate to a ferric chloride to remove uncoated permalloy and MagneDur. With a proper adjustment of the rate that etchant spray was applied to each side to match the etching rate of the two metals, the foil laminate was etched in one pass for 30 minutes. The resulting laminate thus included patterned signal producing and signal blocking layers in registration with each other. Dual status EAS markers were produced by punching rings having an outer diameter of 41 mm (1.625 in) and an inner diameter of 16 mm (0.625 in). The signal producing layer yielded a detectable EAS signal when the signal blocking layer was in the demagnetized state. After the signal blocking layer was magnetized by a 150 gauss DC magnetic field, the signal producing element did not generate a detectable EAS signal when subjected to interrogating fields of up to 15 Oersteds.

The marker of the present invention may be used with any article for which inventory control is desired. Although described primarily with reference to their use on optical discs, markers of the present invention may be used on other things that are sold, leased, or loaned to the public. Thus, the invention shall be limited only by the following claims.

I claim:

1. An electronic article surveillance marker, comprising:

a) a signal producing layer including flux collection portions each joined to an adjacent flux collection portion by a single magnetic switching section each having a major axis A, wherein the major axis A is orientated through a midpoint of the magnetic switching section and extends in the direction of the adjacent flux collection portion; and b) a signal blocking layer comprising discrete signal blocking elements overlying each flux collection portion, the elements each having at least one boundary that overlies a magnetic switching section and has a tangent T that is not perpendicular to the major axis A of that magnetic switching section.

2. The electronic article surveillance marker of claim 1, wherein the boundaries between adjacent signal blocking elements are complementary.

3. The electronic article surveillance marker of claim 1, wherein the boundaries between adjacent signal blocking elements are not complementary.

4. The electronic article surveillance marker of claim 1, wherein the signal producing layer includes four flux collection portions.

5. The electronic article surveillance marker of claim 1, wherein each signal blocking element includes a boundary defining only one flux concentration point.

6. The electronic article surveillance marker of claim 1, wherein the marker includes a hole formed in the center thereof.

7. The electronic article surveillance marker of claim 1, wherein the marker includes a layer of adhesive on one surface thereof for adhering the marker to a surface of an article.

8. The electronic article surveillance marker of claim 1, wherein the marker includes a printable surface.

9. The electronic article surveillance marker of any of claims 1 through 8, in which the marker is bonded to an optically recorded media disc.

* * * * *